US007204234B2

(12) United States Patent
Morita

(10) Patent No.: US 7,204,234 B2
(45) Date of Patent: Apr. 17, 2007

(54) HIGH-PRESSURE FUEL INJECTION PIPE

(75) Inventor: Yoshiharu Morita, Mishima (JP)

(73) Assignee: Usui Kokusai Sangyo Kaisha Limited (JP)

( * ) Notice: Subject to any disclaimer, the term of this patent is extended or adjusted under 35 U.S.C. 154(b) by 9 days.

(21) Appl. No.: 11/146,374

(22) Filed: Jun. 6, 2005

(65) Prior Publication Data

US 2005/0279327 A1 Dec. 22, 2005

(30) Foreign Application Priority Data

Jun. 17, 2004 (JP) ..... 2004-180184

(51) Int. Cl.
*F02M 55/02* (2006.01)
*F02M 55/00* (2006.01)

(52) U.S. Cl. ..... 123/468; 138/143

(58) Field of Classification Search ..... 123/468; 138/143, 141, 142, 145, 140, 177, 109; 285/133.5, 285/189, 188
See application file for complete search history.

(56) References Cited

U.S. PATENT DOCUMENTS 2,508,465 A * 5/1950 Offinger et al. ..... 138/142
4,346,739 A * 8/1982 Asada ..... 138/143
4,784,311 A * 11/1988 Sugao ..... 228/131
4,832,376 A 5/1989 Sugao
4,893,601 A 1/1990 Sugao
4,900,180 A 2/1990 Takikawa
5,120,084 A 6/1992 Hashimoto
5,143,410 A 9/1992 Takikawa
5,169,182 A 12/1992 Hashimoto
5,172,939 A 12/1992 Hashimoto
5,265,793 A * 11/1993 Usui et al. ..... 228/127
5,520,223 A * 5/1996 Iorio et al. ..... 138/140
5,667,255 A 9/1997 Kato
5,887,628 A * 3/1999 Usui ..... 138/142
5,887,910 A 3/1999 Usui
5,903,964 A 5/1999 Uematsu et al.
5,957,507 A 9/1999 Asada
5,979,945 A 11/1999 Hitachi et al.
5,992,904 A 11/1999 Hitachi et al.
6,050,301 A * 4/2000 Yoshida et al. ..... 138/143

(Continued)

FOREIGN PATENT DOCUMENTS

JP 52-756 1/1977

(Continued)

*Primary Examiner*—Mahmoud Gimie
(74) *Attorney, Agent, or Firm*—Gerald E. Hespos; Anthony J. Casella

(57) ABSTRACT

A high-pressure fuel injection pipe, which has an outside diameter (ϕ) of 6.35 mm, an inside diameter (ϕ) of 4.35 to 2.95 mm, and a wall thickness (t)of about 1.0 to 1.7 mm, can serve as a high-pressure fuel injection pipe for in-cylinder injection type gasoline engines which have an injection pressure of 4 to 20 MPa, and can adequately endure the use of low-grade gasoline, sour gasoline, DME (dimethyl ether), alcohol, alcohol blended fuel, etc. is provided. The high-pressure fuel injection pipe is manufactured by joining an outer pipe which is an seam-welded pipe or a seamless pipe and an inner pipe which is an seam-welded pipe with a Ni or Ni base alloy film on its inner peripheral surface, closely adhering them together by means of elongation.

8 Claims, 2 Drawing Sheets

U.S. PATENT DOCUMENTS

| | | | | |
|---|---|---|---|---|
| 6,050,611 | A | 4/2000 | Asada | |
| 6,070,618 | A | 6/2000 | Iwabuchi | |
| 6,126,208 | A | 10/2000 | Asada et al. | |
| 6,205,661 | B1 * | 3/2001 | Ring | 29/890.01 |
| 6,397,881 | B1 | 6/2002 | Asada et al. | |
| 6,408,826 | B2 | 6/2002 | Asada et al. | |
| 6,415,768 | B1 | 7/2002 | Usui | |
| 6,463,909 | B2 | 10/2002 | Asada et al. | |
| 6,494,183 | B2 | 12/2002 | Usui et al. | |
| 6,659,137 | B2 * | 12/2003 | Imasaki et al. | 138/142 |
| 6,840,283 | B2 | 1/2005 | Furugen et al. | |
| 6,843,275 | B2 | 1/2005 | Kato | |
| 2006/0037660 | A1 * | 2/2006 | Kinnally et al. | 138/143 |

FOREIGN PATENT DOCUMENTS

| | | |
|---|---|---|
| JP | 56-034064 | 4/1981 |
| JP | 2-80289 | 6/1990 |
| JP | 3-177693 | 8/1991 |
| JP | 4-175462 | 6/1992 |
| JP | 05-009786 | 1/1993 |
| JP | 05-156494 | 6/1993 |

* cited by examiner

HIGH-PRESSURE FUEL INJECTION PIPE

TECHNICAL FIELD

The present invention relates to a high-pressure fuel injection pipe for internal combustion engines, and more particular, to a high-pressure fuel injection pipe for in-cylinder injection type gasoline engines or intake manifold injection type gasoline engines or diesel engines, the high-pressure fuel injection pipe being for injection pressure of 4 to 20 MPa and having a measure of an outside diameter (ϕ) of 6.35 mm, an inside diameter (ϕ) of 4.35 to 2.95 mm, and a wall thickness (t) of 1.0 to 1.7 mm.

BACKGROUND ART

As a conventional high-pressure fuel injection pipe for internal combustion engines such as in-cylinder injection type gasoline engines, there are known, for example, a fuel injection pipe for diesel engines, which is manufactured by repeating elongation and heat treatment of a thick-walled seamless steel pipe (material: STS35) (see JP-A-52-756), a fuel injection pipe for diesel engines, which is manufactured by repeating elongation and heat treatment of a thick-walled seamless stainless steel pipe (see JP-A-54-110958), and a welded pipe whose steel base is not exposed anywhere, made by forming, as a first plated layer, a plated layer of Ni, Co, or a base alloy thereof on at least one surface of a band steel sheet, forming, as a second plated layer on the first plated layer, a single metal or an alloy thereof having a lower melting point than the single metal of base alloy thereof of the first plated layer, using the band steel sheet formed with the two plated layers to fabricate an seam-welded pipe, and then performing heat treatment (see JP-A-5-9786). Further, there is known a welded pipe manufactured by forming a first plated layer composed of Sn, Sn—Zn, Sn—Ni, Ni—P, or Ni—B on at least one surface of a band steel sheet, forming, as a second plated layer on the first plated layer, Ni, Co, and one of the base metal alloys thereof which has a higher melting point than the metal forming the first plated layer, using the band steel sheet formed with the two plated layers to fabricate a pipe, and then performing heat treatment (see JP-A-5-156494).

DISCLOSURE OF INVENTION

With a fuel injection pipe for diesel engines manufactured by repeating elongation and heat treatment of a thick-walled seamless steel pipe (material: STS35), however, iron is exposed at the inner peripheral surface of the pipe, so that the pipe cannot endure the use of low-grade gasoline, sour gasoline, DME (dimethyl ether), alcohol, alcohol blended fuel, etc., and the problems arise that generation of rusting is unavoidable and that the pipe is heavy, bends poorly due to its large wall thickness, and is expensive. Also, a fuel injection pipe for diesel engines manufactured by repeating elongation and heat treatment of a thick-walled seamless stainless steel pipe is made of stainless steel to be free from generation of rusting on the inner peripheral surface, but this causes the problems that this material is not only expensive, but also heavy due to its large wall thickness and bad in workability due to its high hardness. Further, like the fuel injection pipe made of stainless steel, in the case of a welded pipe whose inner peripheral surface is coated with a Ni or Ni alloy base film, rust is not generated on the inner peripheral surface, but an seam-welded pipe having a small outside diameter (ϕ) of 6.35 mm is difficult to form since a band steel material having a large-wall thickness t of 0.9 to 1.5 mm must be used for a pipe which has for example an outside diameter ϕ of 6.35 mm, an inside diameter (ϕ) of 4.35 to 2.95 mm, and a wall thickness (t) of 1.0 to 1.7 mm, as is demanded for the high-pressure fuel injection pipe for in-cylinder injection type gasoline engines subjected to an injection pressure of 4 to 20 Mpa to which the invention is to be applied.

The invention has been thought of in view of these problems and has its object to provide a high-pressure fuel injection pipe for internal combustion engines, which adequately endures the use of low-grade gasoline, sour gasoline, DME (dimethyl ether), alcohol, alcohol blended fuel, etc., has a measure of an outside diameter (ϕ) of 6.35 mm, an inside diameter (ϕ) of 4.35 to 2.95 mm, and a wall thickness (t) of 1.0 to 1.7 mm, as is demanded for a high-pressure fuel injection pipe for in-cylinder injection type gasoline engines subjected to an injection pressure of 4 to 20 MPa.

A high-pressure fuel injection pipe according to the invention comprises a pipe in which an outer pipe composed of an seam-welded pipe or a seamless pipe, and an inner pipe composed of an seam-welded pipe having a Ni or Ni base alloy film on an inner peripheral surface thereof are closely adhered together by elongating them together, on the inner peripheral surface of the inner pipe is applied a Ni plated layer and then a Ni-P alloy plated layer, after which the layers are subjected to thermal diffusion, a pipe in which closely adhered surfaces of the above outer pipe and the inner pipe are brazed or diffusion bonded, a pipe in which the outer pipe composed of an seam-welded pipe is beforehand subjected to core drawing, a pipe in which the inner pipe is beforehand subjected to heat treatment and core drawing after seam welding, a pipe in which the inner pipe is not beforehand subjected to heat treatment and core drawing after seam welding, a pipe comprising, at least on one end, a frustum shaped connection head whose longitudinal cross sectional profile outer seat surfaces which are straight or arcuate, and a pipe structured such that an opened end surface of the outer pipe is covered by an opened end of the inner pipe so that the inner peripheral surface of the inner pipe becomes the seat surface, and further comprising a spool or a projection as a nut pressure bearing part receiving the pressure of a connection nut.

Since the invention comprises a pipe in which an outer pipe composed of an seam-welded pipe or a seamless pipe, and an inner pipe composed of an seam-welded pipe having a Ni or Ni base alloy film on its inner peripheral surface are closely adhered together by drawing, it adequately endures the use of low-grade gasoline, sour gasoline, DME (dimethyl ether), alcohol, alcohol blended fuel, etc., and causes no deterioration of fuel because there is no copper film on the inner peripheral surface, unlike a double steel pipe. Besides, since the outer peripheral surface of the pipe is made smooth by using a seamless pipe or an seam-welded pipe for the outer pipe, a seat surface formed by a frustum shaped connection head having an outer peripheral surface, whose longitudinal cross sectional profile outer seat surfaces are straight or arcuate, the pipe end is smooth and can surely seal in fuel having a high pressure of 4 to 20 MPa. Also, since the pipe is relatively small in wall thickness, it is made smaller in weight than conventional ones and favorable in bending so that it is relatively inexpensive. Also, since the band steel material used has a wall thickness (t) as small as 0.6 to 0.7 mm, it is possible to fabricate an seam-welded pipe having a small outside diameter (ϕ) of 6.35 mm.

BEST MODE FOR CARRYING OUT THE INVENTION

Figure 1:
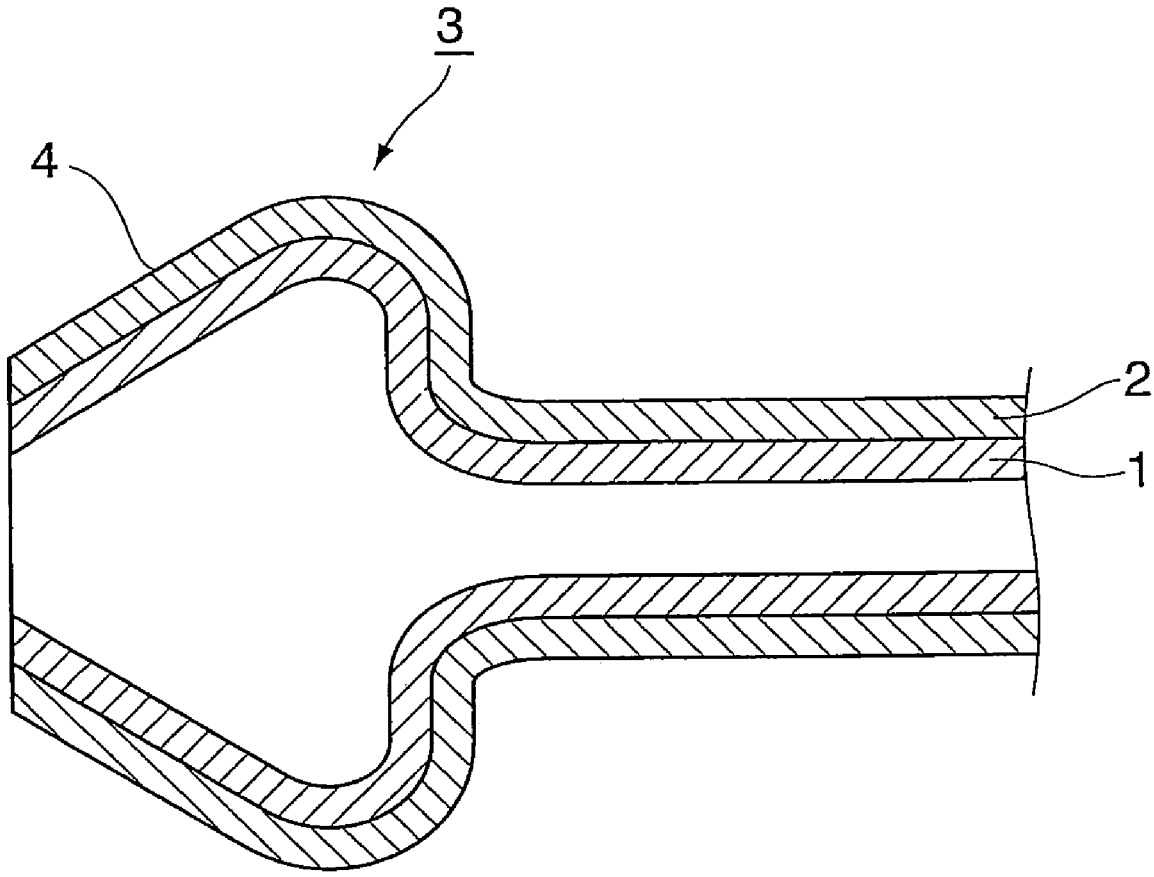
FIG. 1 is a schematic, longitudinal sectional view showing an essential part of an embodiment of a high-pressure fuel injection pipe according to the invention.

In the invention, the reference numerals 1, 11, 21 denote an inner pipe, 2, 12, 22 an outer pipe, 3 a connection head, 4, 14, 24 a seat surface, and 13, 23 a spool ridge (projection).

The invention adopts, an inner pipe 1, 11, 21, which is an seam-welded pipe having a Ni or Ni base alloy film on its inner peripheral surface and outer pipe 2, 12, 22, which is an seam-welded pipe or a seamless pipe. A high-pressure fuel injection pipe shown in FIG. 1 includes a frustum shaped connection head 3 having an outer peripheral surface whose longitudinal cross sectional profile outer seat surfaces are straight or arcuate (not shown), disposed on at least one end of the pipe which is a double pipe composed of the inner pipe 1 and the outer pipe 2.

Figure 2A:
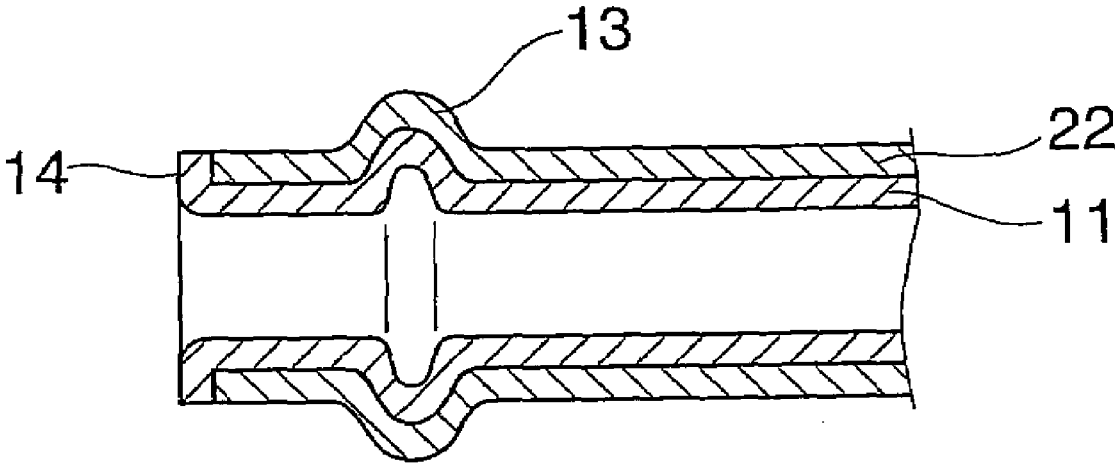
FIG. 2A is a schematic, longitudinal sectional view showing an essential part of a further embodiment of a high-pressure fuel injection pipe according to the invention, the high-pressure fuel injection pipe including a spool ridge formed from an inner pipe and an outer pipe.
Figure 2B:
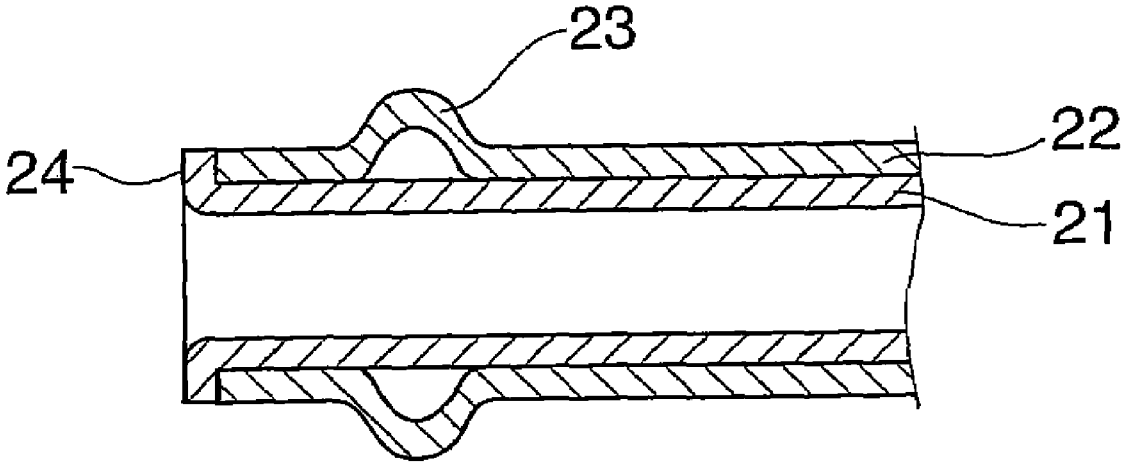
FIG. 2B is a schematic, longitudinal sectional view showing an essential part of a still further embodiment of a high-pressure fuel injection pipe according to the invention, the high-pressure fuel injection pipe including a spool ridge formed only from an outer pipe.

High-pressure fuel injection pipes shown in FIGS. 2A and 2B are structured such that an opened end surface of the outer pipe 12, 22 is covered by an opened end of the inner pipe 11, 21 so that the inner peripheral surface of the inner pipe 11, 21 becomes a seat surface 14, 24. A spool ridge 13, 23 serving as a nut pressure bearing part for a connection nut (illustration thereof omitted) is formed by the inner pipe 11 and the outer pipe 12 for the high-pressure fuel injection pipe shown in FIG. 2A, and is formed only by the outer pipe 12 for the high-pressure fuel injection pipe shown in FIG. 2B.

In the case where the high-pressure fuel injection pipe according to the invention comprises a double pipe where both the inner pipe 1, 11, 21 and the outer pipe 2, 12, 22, the inner pipe 1, 11, 21 are seam-welded pipe, it is manufactured by forming an seam-welded pipe from a band steel, of which only one surface which will be the inner surface side is subjected to Ni plating of 4 μm or 3 μm to 10 μm by means of a usual method (an electric or chemical plating method being usually performed), and subjecting the seam-welded pipe to a predetermined heat treatment. The outer pipe 2, 12, 22 is manufactured by subjecting the surface to be the inner surface side to Cu plating of 4 μm or 3 μm to 10 μm, and then forming an seam-welded pipe from the band steel by means of core drawing while cutting bead from the inner and outer surfaces of the seam-welded pipe, and then subjecting the seam-welded pipe to a predetermined heat treatment. Subsequently, the inner pipe 1, 11, 21 is inserted into the outer pipe 2, 12, 22 to form a composite pipe, and the composite pipe is subjected to drawing to a predetermined outside diameter in a draw bench. Thereafter, the double pipe having been subjected to drawing is subjected to heat treatment to braze or diffuse the Cu plated layer of the inner wall of the outer pipe to the outer wall of the inner pipe, thus performing diffusion bonding at least partially. After being worked to a target size, the double pipe is cut to a desired length, and subjected to processing such as fabrication of a head portion of a desired shape, or inserting a connection part such as nut or the like onto the outer periphery of the double pipe, forming of the spool 12, 23, and the like. The bead on the inner peripheral surface of the inner pipe may be cut off by means of drawing a plug/die through the core.

Also, in the case where the double pipe is composed of an inner pipe 1, 11, 21, which is an seam-welded pipe, and an outer pipe 2, 12, 22, which is a seamless steel pipe, the inner pipe 1, 11, 21 is manufactured by forming an seam-welded pipe from a band of steel, of which only the surface which will be the inner surface side is subjected to Ni plating of thickness 4 μm or 3 μm to 10 μm by means of a usual method, and then subjected to Ni—P alloy plating of thickness 4 μm or 3 μm to 10 μm on the Ni plating, and then subjecting the seam-welded pipe to a predetermined heat treatment. On the other hand, a seamless steel pipe only the inner surface of which is subjected to Cu plating is used for the outer pipe 2, 12, 22. In the process of composition, after the composite pipe composed of the inner pipe (seam-welded pipe) 1, 11, 21 and the outer pipe (seamless steel pipe) 2, 12, 22 is subjected to drawing to a predetermined outside diameter in a draw bench, the resulting double pipe is joined by means of heat treatment to diffuse and braze the Cu plated layer of the inner wall of the outer pipe to the outer wall of the inner pipe. Then, after being worked to a target size, the double pipe is cut to a desired length, and a head portion of a desired shape is fabricated by inserting a connection part such as nut or the like onto an outer periphery of the double pipe. The bead on the inner peripheral surface of the inner pipe may be cut off by drawing a plug/die through the core.

In the case where the high-pressure fuel injection pipe in the invention comprises a double pipe where both the inner pipe 1, 11, 21 and the outer pipe 2, 12, 22 are seam-welded pipes, it is preferable that the Ni plated layer formed on the inner pipe 1, 11, 21 has a film thickness of 3 to 10 μm and the Cu plated layer formed on the outer pipe 2, 12, 22 has a film thickness of 3 to 8 μm.

Also, in the case where the high-pressure fuel injection pipe comprises a double pipe with the inner pipe 1, 11, 21 being an seam-welded pipe and the outer pipe 2, 12, 22 being a seamless steel pipe, it is preferable that the Ni plated layer and the Ni—P plated layer formed successively on the inner pipe inner surface have a film thickness of 4 to 8 μm and a film thickness of 2 to 5 μm respectively, and the Cu plated layer formed on the outer pipe 2 has a film thickness of 3 to 8 μm.

In addition, it suffices that the material for the band steel sheet in the invention is that usually used for car fuel pipes. Also, Cu plating applied to the inner surface of the outer pipe may be applied to the outer surface of the inner pipe, and Ni—P plating may be also applied.

As done usually, pipes are fabricated by respective processes such as cutting a hoop material to a predetermined widthwise dimension, using the roll forming method to form the material in a pipe shape so that the plated surface is on the inner side, welding the portions abutting each other, performing bead-cutting by core drawing, and then performing heat treatment.

An inner pipe was manufactured by cutting a band steel sheet (JIS G 3141 SPCC), only the surface which will be the inner surface being coated with a Ni plated layer having a film thickness of 4 μm by means of a usual method to a thickness of 0.6 mm, to a developed width of a raw pipe, forming the band steel sheet into a pipe shape by roll forming, subjecting the abutting portions to seam welding, then performing reducing (narrowing) to provide a pipe having an outside diameter of 6 mm and a wall thickness of 0.7 mm, bead-cutting the inner surface of the pipe, and heat treating the seam-welded pipe at 800° C. for 3 to 6 minutes.

Subsequently, an outer pipe having an outside diameter of 9 mm and a wall thickness of 1.0 mm was manufactured from a band steel sheet which has a thickness of 0.7 mm (JIS G 3141 SPCC), only the surface which will be the inner surface of the pipe being coated with a Cu plated layer having a film thickness of 4 μm by means of a usual method. The manufacturing method was the same as the inner pipe, and comprised cutting a band steel sheet to the desired width of the unprocessed pipe opened out, forming the band steel sheet into a pipe shape by roll forming, subjecting the abutting portions to seam welding, then performing reducing (narrowing) on the produced pipe, performing bead-cutting, heat treating the seam-welded pipe at 800° C. or higher for 3 to 6 minutes, and cutting beads from the inner surface by means of drawing a plug/die through the core.

Subsequently, the inner pipe (outside diameter of 6 mm and wall thickness of 0.7 mm) was inserted into the outer pipe (an outside diameter of 9 mm and a wall thickness of 1.0 mm) to form a composite pipe, the composite pipe was subjected to drawing to a predetermined outside diameter of 8 mm in a draw bench, and subsequently, the double pipe drawn to have an outside diameter of 8 mm and a wall thickness of 1.5 mm was heated to 1120° C. for 2 to 10 minutes to have the Cu plated layer on an inner wall of the outer pipe brazed and joined to the outer wall of the inner pipe, and then the double pipe was subjected to drawing to an outside diameter of 6.35 mm and a wall thickness of 1.0 mm by core drawing with a draw bench. The double pipe was cut to a desired length in the final process, and a connection part such as nut or the like was inserted to fabricate a head portion of a desired shape.

As a result of carrying out a salt spray test according to the procedure of JIS Z2371 on the inner surface of the resulting high-pressure fuel injection pipe, rusting was not observed even after the lapse of 1 to 2 hours and so it was confirmed that the pipe had excellent corrosion resistance. Further, a bending test, in-which the pipe was bent to 180° with a radius of 20 mm by means of a grooved roll, and evaluation tests such as press working of an end of the pipe were carried out, but generation of crack, peel, or the like on the plated film were not observed.

An seam-welded pipe having an inner pipe of 6 mm outside diameter and a wall thickness of 0.7 mm was manufactured by the same manufacturing method as that in the first embodiment from a band steel sheet of thickness 0.6 mm (JIS G 3141 SPCC), only the surface which will be the inner surface side of the pipe being coated with a Ni plated layer with thickness of 4 μm, and then coated with a Ni—P alloy layer of 4 μm thickness on the Ni plated layer, by means of a usual method. This electric resistance welded inner pipe was heat treated at 800° C. or higher for 3 to 6 minutes. An outer pipe obtained by forming a Cu plated layer having a film thickness of 4 μm only on the inner surface of a seamless steel pipe having an outside diameter of 9 mm and a wall thickness of 1.2 mm by means of a usual method was used. The double pipe was subjected to joining by core drawing as in the first embodiment, reduced to an outside diameter of 8 mm, and heat treated at 1130° C. for 2 to 10 minutes to braze and join the Cu plated layer on the inner wall of the outer pipe to the outer wall of the inner pipe, and then the double pipe was subjected to drawing to an outside diameter of 6.35 mm and a wall thickness of 1.7 mm by core drawing with a draw bench. The double pipe was cut to a desired length in the final process, and a connection part such as a nut was inserted to fabricate a head portion of a desired shape.

As a result of carrying out a salt spray test on the inner surface of the resulting high-pressure fuel injection pipe in the same manner as that in the first embodiment, rusting was not observed even after the lapse of 24 hours and so it was verified that the pipe had excellent corrosion resistance. Further, generation of crack, peel, or the like was not recognized in a bending test and an evaluation test.

While a high-pressure fuel injection pipe having a finished outside diameter of 6.35 mm has been illustrated as an example, it goes without saying that the invention is not limited thereto.

INDUSTRIAL APPLICABILITY

The high-pressure fuel injection pipe according to the invention adequately endures the use of low-grade gasoline, sour gasoline, DME (dimethyl ether), alcohol, alcohol blended fuel, etc., causes no deterioration of a fuel, and can reliably seal in fuel having a high pressure of 4 to 20 MPa. Further, since the band steel sheet used has a small wall thickness (t) of 0.6 to 0.7 mm, it is also possible to provide a high-pressure fuel injection pipe made by seam welding having a small outside diameter (ϕ) of 6.35 mm.

What is claimed is:

1. A high-pressure fuel injection pipe, in which an outer pipe which is a seam-welded pipe or a seamless pipe, and an inner pipe which is a seam-welded pipe having a Ni or Ni base alloy film on its inner peripheral surface are closely adhered together by elongation, an opened end surface of the outer pipe being covered by an opened end of the inner pipe so that the inner peripheral surface of the inner pipe becomes a seat surface, and further comprising a spool ridge projection serving as a nut pressure bearing part for holding a connection nut.

2. The high-pressure fuel injection pipe according to claim 1, wherein the inner pipe is a seam-welded pipe having an inner peripheral surface on which a Ni plated layer is applied and then Ni-P alloy plated layer is applied and which is subjected to thermal diffusion.

3. The high-pressure fuel injection pipe according to claim 2, wherein surfaces of the outer pipe and the inner pipe closely adhered to each other are brazed or diffusion bonded.

4. The high-pressure fuel injection pipe according to claim 1, wherein the outer pipe which is a seam-welded pipe is beforehand subjected to core drawing.

5. The high-pressure fuel injection pipe according to claim 1, wherein the inner pipe is beforehand subjected to heat treatment and core drawing after seam welding.

6. The high-pressure fuel injection pipe according to claim 1, wherein the inner pipe is not beforehand subjected to heat treatment and core drawing after seam welding.

7. The high-pressure fuel injection pipe according to claim 1, comprising, at least on one end thereof, a frustum shaped connection portion whose longitudinal cross sectional profile outer seat surfaces are straight or arcuate.

8. The high-pressure fuel injection pipe according to claim 1, wherein surfaces of the outer pipe and the inner pipe closely adhered to each other are brazed or diffusion bonded.

* * * * *